US006901639B2

(12) United States Patent
Freiberg et al.

(10) Patent No.: US 6,901,639 B2
(45) Date of Patent: Jun. 7, 2005

(54) STRETCHING MACHINE

(75) Inventors: Helge Freiberg, Mönchengladbach (DE); Gottfried Baum, Erkelenz (DE); Thomas Tinschert, Wassenberg (DE); Hans Mingers, Korschenbroich (DE)

(73) Assignee: A. Monforts Textilmaschinen GmbH & Co., Mönchengladbach (DE)

( * ) Notice: Subject to any disclaimer, the term of this patent is extended or adjusted under 35 U.S.C. 154(b) by 0 days.

(21) Appl. No.: 10/486,858

(22) PCT Filed: Jun. 12, 2003

(86) PCT No.: PCT/DE03/01927

§ 371 (c)(1),
(2), (4) Date: Sep. 16, 2004

(87) PCT Pub. No.: WO03/106754

PCT Pub. Date: Dec. 24, 2003

(65) Prior Publication Data

US 2005/0034285 A1 Feb. 17, 2005

(30) Foreign Application Priority Data

Jun. 15, 2002 (DE) ..... 102 26 787

(51) Int. Cl.[7] ..... D06C 3/02
(52) U.S. Cl. ..... 26/89; 26/92; 26/96
(58) Field of Search ..... 26/87–96, 98, 26/106, 71–73, 51, 52, 53, 86; 264/288.4, 288.8, 289.3, 291, 290.2; 425/102, 75, 500, 503; 118/33, 34; 34/90, 619, 623, 660, 662, 664; 226/88, 102; 242/615.21; 28/165

(56) References Cited

U.S. PATENT DOCUMENTS 1,524,024 A * 1/1925 Dod ..... 26/89
1,896,588 A * 2/1933 Laurie ..... 26/86
2,410,907 A * 11/1946 Stowell ..... 26/79
2,559,713 A * 7/1951 Dunski et al. ..... 34/421
3,418,702 A * 12/1968 Coburn ..... 26/91
3,552,248 A * 1/1971 Pernick ..... 83/151
3,605,280 A * 9/1971 Fleissner ..... 34/115
3,638,289 A * 2/1972 Dornier et al. ..... 26/93
4,103,403 A * 8/1978 Parrillo et al. ..... 26/91
4,134,189 A * 1/1979 Richter ..... 26/89
4,290,236 A 9/1981 Brewer et al.
4,316,309 A * 2/1982 Richter ..... 26/93
4,602,407 A * 7/1986 Gresens ..... 26/89
4,882,820 A * 11/1989 MacKinnon et al. ..... 26/93
5,067,214 A * 11/1991 Hosmer et al. ..... 26/89
5,084,949 A * 2/1992 Rutz et al. ..... 26/72
5,667,442 A 9/1997 Tanaka
5,862,574 A * 1/1999 Poterala ..... 26/89
5,970,589 A * 10/1999 Hayashi et al. ..... 26/89

FOREIGN PATENT DOCUMENTS

| | | |
|---|---|---|
| DE | 1087555 | 8/1960 |
| DE | 3333938 | 4/1985 |
| EP | 0073915 | 3/1983 |
| GB | 1319470 | 6/1973 |

* cited by examiner

*Primary Examiner*—Amy B. Vanatta
(74) *Attorney, Agent, or Firm*—Collard & Roe, P.C.

(57) ABSTRACT

A stentering machine having a horizontal drying zone and a vertical pretreatment zone for a web of material spread out between stentering chains is described. The stentering chains are brought from the vertical position into a horizontal position in a deflection zone. In order to achieve the result, in the case of a stentering chain with deflection about axes that stand vertical to the surface of the web of material, that the chain can be guided through the deflection zone with tilting of the linking pins, without damage to the pin bearings, the deflection pins are configured to be crowned elements. The deflection bolt bearings are shaped to correspond to the crowning of the pins.

4 Claims, 2 Drawing Sheets

STRETCHING MACHINE

CROSS REFERENCE TO RELATED APPLICATIONS

Figure 1:
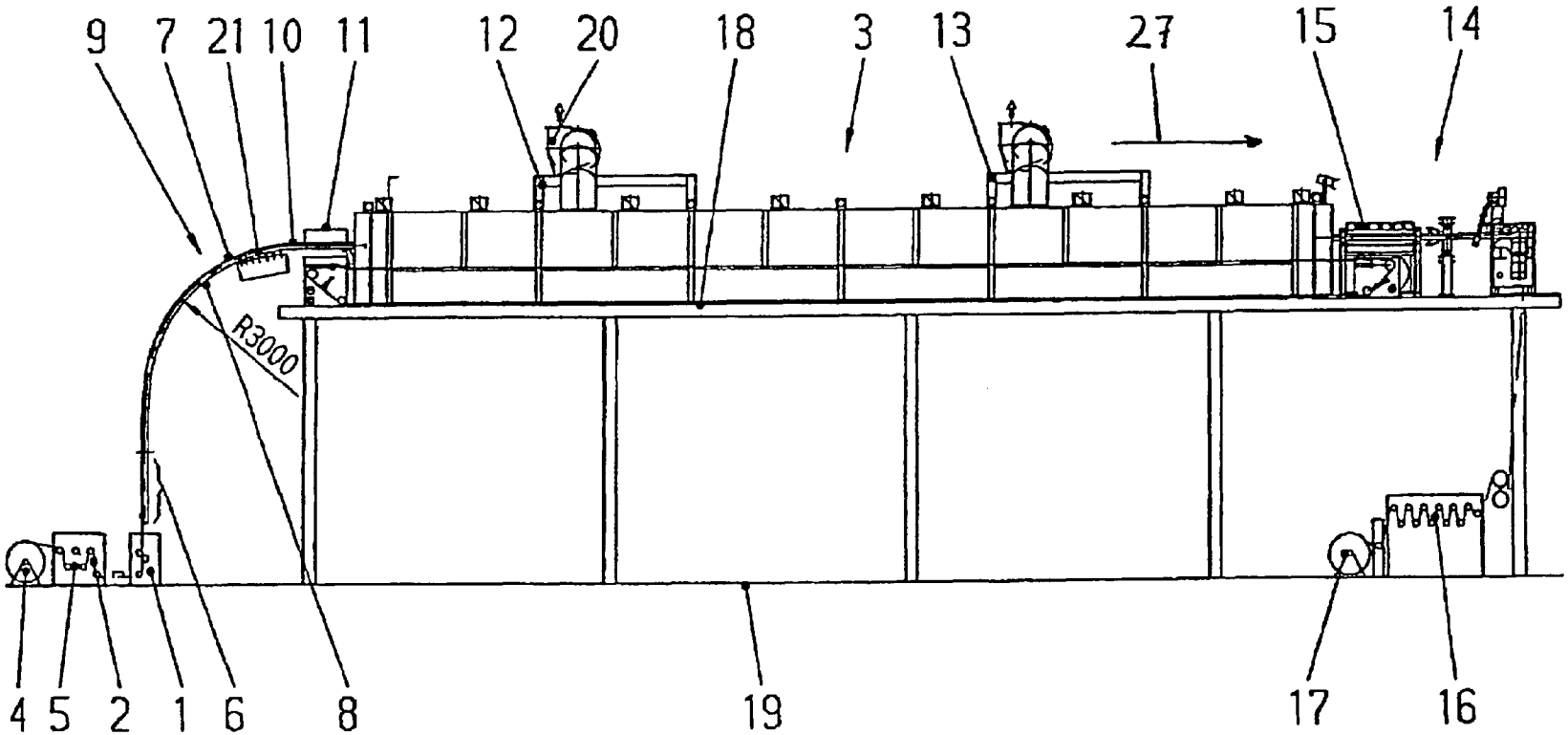

Applicants claim priority under 35 U.S.C. §119 of GERMAN Application No. 102 26 787.1 filed on Jun. 15, 2002. Applicants also claim priority under 35 U.S.C. §365 of PCT/DE03/01927 filed on Jun. 2, 2003. The international application under PCT article 21(2) was not published in English.

Specification

The invention relates to a stentering machine having a horizontal drying zone for continuous treatment of a web of material spread out between stentering chains comprised of chain links, the two lengthwise edges of which are to be attached to the chain links in a coupling zone, in releasable manner, whereby each of the chain links possesses linking pins that are to be coupled with an adjacent chain link, in each instance, in pivoting manner, the axes of which stand essentially perpendicular to the plane of the web of material, whereby guide rails, which are horizontal in the drying zone, having bearing roller tracks or glide tracks for the chains, are assigned to the stentering chains.

The stentering chains are endless. Viewed in the web transport direction, they are deflected around shafts, ahead of the coupling zone (needling-in field) and behind an uncoupling zone (needling-out field), the axes of which stand perpendicular to the adjacent surface of the web of material. In the case of conventional flat tenter frames, one speaks, in this connection, of a horizontal chain deflection, i.e. of a deflection of the chain in a plane parallel to the plane of the web of material.

The present stentering machine is supposed to be suitable for drying a pretreated web of material, for example one coated on both sides in a pretreatment zone, or a web of material comprised of glass fibers or containing glass fibers, which was coated and/or dyed in the pretreatment zone. Coated webs of material are generally only allowed to be touched, for example deflected around rollers, once the coating has dried. Glass fibers frequently hold dyes more poorly than does the surface of the rollers usually used in textile machines, so that these are only supposed to touch the surface of the glass fiber web of material once the applied substance has dried.

There are tenter frame dryers having stentering chains comprised of chain links for a web of material stretched out between the stentering chains, e.g. a textile web of material. The web is held in needles or tenterhooks at its two lengthwise edges and passed through a drying zone and, if necessary, through a fixing zone. Placement of the edges of the web onto the needles or tenterhooks takes place in a needling-in zone or tenterhooking-in zone, a coupling zone for short. An example of such a stentering frame is described in EP 00 73 915 B1.

As a rule, the stentering chains run in or on guide rails that absorb the weight of the stentering chain and the web of material they carry, on the one hand, as well as the crosswise tension exerted on the web of material (crosswise to the web transport direction), on the other hand. In the case of a normal flat stentering frame (having a single treatment plane), the guide rails lie essentially horizontally. They possess roller tracks or glide tracks, which carry the weight of the chain (including the web of material, if applicable). In addition, each guide rail has a stentering roller track or stentering glide track that absorbs the crosswise tension exerted on the web of material, in each instance. An example of a stentering chain equipped with corresponding glide elements is described in DE 33 33 938 A1.

In devices in which a running web of material is to be coated on both surfaces, the web is drawn through the coating unit in perpendicular manner, from the bottom to the top. The vertical web guidance has the advantage that the coating conditions are the same on both web surfaces, in contrast to horizontal web guidance. Since the freshly coated surface of the web is only allowed to be touched after it has dried, the material, after having come out of the coating unit, is first passed through a dryer arranged perpendicular above the latter. The method of procedure. is very similar for the drying of freshly dyed glass fiber webs.

In the case of some grades of webs of material coming vertically from pretreatment, there is the need to control the web width during drying. For this purpose, the web of material is put into the stentering chains described, stretched to a specific width, and passed to a vertical dryer. Since in most cases, dryers cannot be built to any desired height, since the production facility is not high enough, it was proposed to bring the stentering chains, together with the web of material held in them and coated on both sides, into a horizontal position of a drying zone, by way of a 90° deflection zone of the stentering chains, on curved or bent guide rails, preferably in the shape of a ¼circle (from the vertical into the horizontal), with a Smooth transition.

In the deflection zone, forces are exerted on the chain links (with the linking pins standing perpendicular to the surface of the web of material), which forces act crosswise to the pins and have a "buckling" effect on the chain. It is true that the buckling forces can be reduced by increasing the radius of curvature of the deflection zone. However, in normal production facilities, a radius of curvature of significantly more than 3 m is not possible. In the case of a chain pitch (distance from pin to pin) of 120 mm and a radius of curvature of 3000 mm, however, the axes of the individual pins are angled by about 20° relative to one another in the region of the deflection zone. Conventional horizontally deflected chains do not permit even such a slight degree of buckling. This is because the chain and the pins must be supported without play, since otherwise the chain bearings could swing out. A conventional chain is therefore only allowed to be deflected in the circumference direction of the linking pins, but not buckled crosswise to it.

When controlling the width (spreading) of the web of material, the stentering chains often have to transfer greater crosswise forces of the material. These crosswise forces can be best transferred by a roller/rail system, in advantageous manner, because rolling friction is very much less than glide friction. This results in the use of so-called roller chains, in which the driving forces are relatively small, because of the slight friction, even in the case of great crosswise forces of the material. However, for design reasons, roller chains can only be deflected horizontally.

The invention is based on the task of configuring a so-called "horizontally deflected" tenter frame chain in such a manner that it can also be deflected when the linking pins are tilted spatially, without damage to the bearings (at the linking pins).

The solution according to the invention consists, for the stentering machine described initially, of the fact that the linking pins are configured as crowned elements, for a vertical tilting angle between the chain links that corresponds to the curvature of the deflection zone, in the case of a 90° deflection zone of the guide rails arranged between the vertical coating unit and the horizontal drying zone. The pin bearing in the chain is configured in accordance with the crowning of the pin shape. Some improvements and other embodiments of the invention are described in the dependent claims.

Because of the crowning of the linking pins, and the shaped pin bearing in the chain that corresponds to it, in each instance, the result is achieved that the chain can follow the shape of the deflection zone of the guide track, e.g. ¼ circle deflection zone with a radius of 3 m, by means of spatial tilting of the pin axis, without damaging the pin bearing. In the case of deflection of webs of material coated on both sides from the vertical position (in the coating unit) to the horizontal position (in the drying zone), only very large radii of curvature are permissible, because of possible damage to the fresh coating, which is still damp.

According to a further invention, a crowning for tilting of adjacent linking pins towards one another of on the order of 20° is provided at a chain pitch (distance between adjacent linking pins) of on the order of 120 mm and a radius of curvature of the deflection zone of on the order of 3000 mm. This degree of crowning is generally sufficient in order to pass through a deflection zone that follows the coating unit, without damage, with the chain links resting against the supporting roller tracks or glide tracks of the guide rail at all points. In the case of smaller radii of curvature, the degree of crowning can be increased. In an extreme case, the pins and their bearings can be configured according to the type of ball joints, within the scope of the invention.

Figure 2:
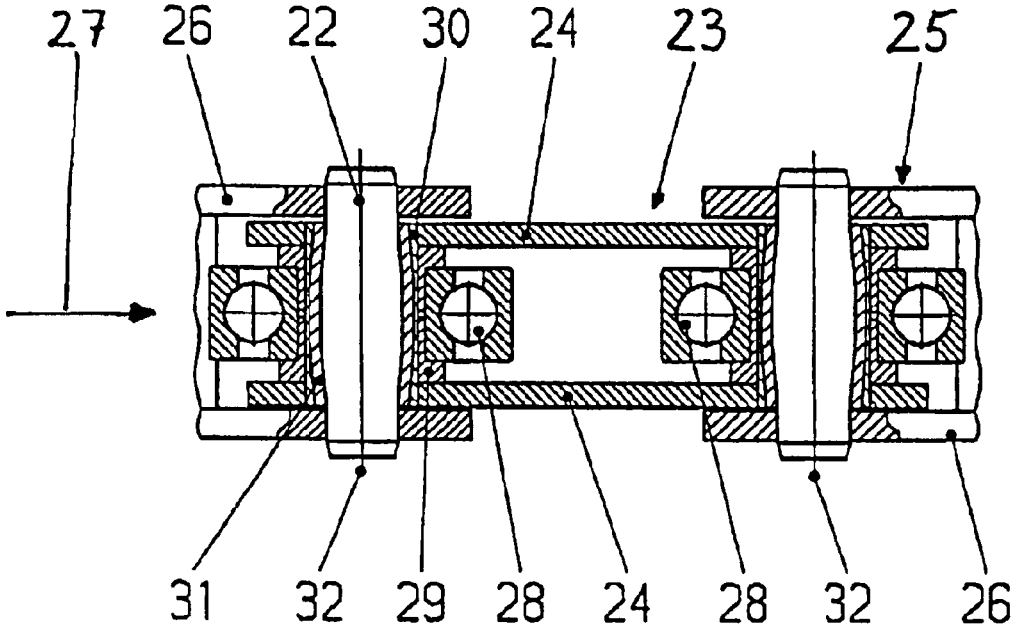

Using the schematic representation of exemplary embodiments, details of the invention will be explained. The drawings show:

FIG. 1 a crosswise cross-section through a device according to the invention, with a horizontal flat tenter frame and a prior vertical coating unit, and FIG. 2 a cross-section on a larger scale, parallel to the plane of the drawing of FIG. 1, through a stentering chain having a crowned pin.

FIG. 1 shows an exemplary embodiment of a device having a coating unit 1 for coating a web of material 2 on both sides, with subsequent drying of the coating in a tenter frame dryer 3. The web of material 2 is guided from the roller 4 into the coating unit, by way of web tension regulators 5. There, the web of material is coated on both sides and drawn essentially vertically upward through a needling-in field 6 (coupling zone). Here, the edges of the web of material are attached to stentering chains 7, which run in guide tracks 8. For this purpose, the chain links of the stentering chains can be equipped with conventional needle strips, in other words needle strips that have been used until now, in standard production. In the exemplary embodiment, the needling-in field 6 has a vertical length of approximately 2 m, subsequent to the coating unit 1.

The needling-in field 6 is followed by a deflection zone 9 in the shape of a quarter circle, the radius of curvature R of which is supposed to amount to approximately 3 m. The deflection zone can open into the drying fields 12, 13, etc., of a conventional stentering frame dryer 3, at its top end 10, horizontally, directly or after passing through an inspection zone 11, for example one with a length of 2 m. The dryer can usually possess one, two, three, or more such drying fields 12, 13. In the exemplary embodiment, the drying fields are followed by a run-out zone 14, for example having a needling-out field 15 and web tension regulators 16, as well as a wind-up roller 17. At the dimensions indicated, the bottom 18 of the tenter frame dryer 3 lies about 5.5 m above the floor 19 of the production facility (on which the coating unit 1 also stands), while the greatest height (here, that of the fans 20) of the system is approximately 9 m. Production facilities of this height are normal. The web 2 can be supported by an air cushion 21 in the region of the deflection zone 9.

FIG. 2 shows a drawing of the stentering chain 7 according to FIG. 1 on a larger scale. In FIG. 2, two linking pins 22 of the stentering chain 7 are shown. The stentering chain 7 consists of chain links 23 having so-called inside tabs 24 and chain links 25 having so-called outside tabs 26. The chain links 23 and 25 are held together by means of the linking pins 22. Accordingly, the linking pins 22 absorb the lengthwise chain forces. Tenterhook strips or needle strips for holding a web of material to be processed at its edges are affixed at the linking pins 22 or at the tabs 24 or 26.

The stentering chain 7 runs in a transport direction 27 during operation, and is stretched in this direction. Horizontal crosswise forces that act on the chain 7 at the same time, from the web of material (not shown) that is to be processed, are absorbed using running rollers 28, which run on appropriately shaped parts of the guide rails 8. The running rollers absorb the crosswise forces of the web of material.

According to FIG. 2, the running rollers 28 are mounted on steel bushings 30, which coaxially surround the pins 22, by way of bushings 29. In the exemplary embodiment, the linking pin 22 is mounted in lubricant-free manner in the steel bushing 30, in each instance, using a plastic bushing 31.

If one were to buckle a chain 7, which possesses precisely cylindrical pins 22 with also precisely cylindrical plastic bushings 31 and steel bushings 30, by tilting the pin axis 32, in each instance, in the plane of the drawing (by applying force), damage to the pin 22, to the plastic bushing 31 and/or to the steel bushing 30 would be expected. A chain with precisely cylindrical linking pins 22 and related precisely cylindrical bearing parts 31, 32 is therefore not allowed to be forced to pass through the deflection zone according to FIG. 1, in any case not if the linking pins 22 stand vertical to the spread-out surface of the treated web of material 2.

According to the invention, the pin 22 is therefore configured as a crowned element in the region of its bearing parts 31, 32. In order to obtain precise guidance of the chain in all positions,. in spite of the crowned pin shape, the bearing parts, namely the plastic bushing 31 and the steel bushing 30, are adapted to the crowning of the pin in their shape. If the crowning of the pin is only supposed to be sufficient for tilting the pin axis 32 by about 2°, the other parts of the chain 7, particularly the running rollers 28 with the related glide bearing 29, can fundamentally remain unchanged.

Reference Symbol List:

| | |
|---|---|
| 1 = | coating apparatus |
| 2 = | web of material |
| 3 = | stentering frame dryer |
| 4 = | roller |
| 5 = | web tension regulator |
| 6 = | needling-in field |
| 7 = | stentering chain |
| 8 = | guide rail |
| 9 = | deflection zone |
| 10 = | top end (9) |
| 11 = | inspection zone |

-continued

| | |
|---|---|
| 12, 13 = | drying field |
| 14 = | run-out zone |
| 15 = | needling-out field |
| 16 = | web tension regulator |
| 17 = | wind-up roller |
| 18 = | bottom (3) |
| 19 = | factory floor |
| 20 = | fan |
| 21 = | air cushion |
| 22 = | linking pin |
| 23 = | chain link |
| 24 = | inside tab |
| 25 = | chain link |
| 26 = | outside tab |
| 27 = | transport direction |
| 28 = | running roller |
| 29 = | bushing |
| 30 = | steel bushing |
| 31 = | plastic bushing |
| 32 = | pin axis |

What is claimed is:

1. Stentering machine having a horizontal drying zone (3) for continuous treatment of a web of material (2) spread out between stentering chains (7) comprised of chain links (23, 25), the two lengthwise edges of which are to be attached to the chain links (23, 25) in a coupling zone (6), in releasable manner, wherein each of the chain links (23) possesses linking pins (22) that are to be coupled with an adjacent chain link (25), in each instance, in pivoting manner, the axes (32) of which stand essentially perpendicular to the plane of the web of material, and wherein guide rails (8), which are horizontal in the drying zone (3), having bearing roller tracks or glide tracks for the chains, are assigned to the stentering chains (7), wherein the linking pins (22) are configured as crowned elements, for a tilting angle between the chain links (23, 25) that corresponds to a radius of curvature of a deflection zone (9), which is a 90° deflection zone (9) of the guide rails (8) arranged between a vertical coating unit (1) and the horizontal drying zone (3).

2. Stentering machine according to claim 1, wherein bearing parts (30, 31) are configured in accordance with the crowning of the linking pin (22).

3. Stentering machine according to claim 1, wherein a crowning for tilting of adjacent linking pins (22) towards one another of approximately 2° is provided at a chain pitch of approximately of 120 mm and a radius of curvature of the deflection zone (9) of approximately 3000 mm.

4. Stentering machine according to claim 1, wherein each linking pin (22) and its bearing parts (29, 30, 31) is configured as a ball joint.

* * * * *